US005400550A

United States Patent [19]

Beasley

[11] Patent Number: 5,400,550

[45] Date of Patent: Mar. 28, 1995

[54] MODULAR TURNTABLE CONSTRUCTION

[76] Inventor: Rex W. Beasley, 837 Traction, Ste. 204, Los Angeles, Calif. 90013

[21] Appl. No.: 134,585

[22] Filed: Oct. 12, 1993

[51] Int. Cl.[6] ..... E04B 1/396

[52] U.S. Cl. ..... 52/65; 472/29; 248/349; 108/22; 104/35; 104/4; 104/46

[58] Field of Search ..... 52/65; 472/29, 35; 248/349; 108/22; 104/35, 44, 46, 99; 245/36.1, 37

[56] References Cited

U.S. PATENT DOCUMENTS

| | | | |
|---|---|---|---|
| 691,062 | 1/1902 | Kunst | 248/349 X |
| 706,891 | 8/1902 | Bramhall | 472/29 X |
| 926,147 | 6/1909 | Slentz | 104/44 |
| 1,040,911 | 10/1912 | Erickson et al. | 104/44 |
| 1,732,113 | 10/1929 | Van Der Meer | 248/349 |
| 1,772,858 | 8/1930 | Coffey | 104/44 |
| 2,764,783 | 10/1956 | Teller | 52/65 |
| 2,808,223 | 10/1957 | Abeles et al. | 248/349 |
| 2,823,425 | 2/1958 | Granek | 52/65 |
| 2,952,221 | 9/1960 | Hobel | 104/44 X |
| 3,078,522 | 2/1963 | Anderson | 52/65 X |
| 3,125,189 | 8/1961 | Graham . | |
| 3,383,810 | 5/1968 | Mola | 52/65 X |
| 3,388,513 | 6/1968 | Bauer . | |
| 3,395,500 | 8/1968 | Smith . | |
| 3,399,501 | 9/1968 | Rossantan . | |
| 3,491,496 | 1/1970 | Johnston | 52/65 |
| 3,547,284 | 12/1970 | Dunbar | 295/37 X |
| 3,675,378 | 7/1972 | Neumann et al. | 52/65 |
| 3,696,805 | 10/1972 | Sweeten et al. | 52/65 X |
| 3,933,400 | 1/1976 | Helgeson | 52/65 X |
| 3,941,146 | 3/1976 | Chatard et al. | 52/65 X |
| 4,191,437 | 3/1980 | Funke | 248/349 X |
| 4,644,707 | 2/1987 | Aubourg et al. . | |
| 4,697,392 | 10/1987 | Silzle | 52/65 |
| 5,117,596 | 6/1992 | Leslie et al. . | |

FOREIGN PATENT DOCUMENTS

| | | | |
|---|---|---|---|
| 2242522 | 3/1975 | France | 52/65 |

OTHER PUBLICATIONS

Hvair Air Film Vehicle Turntables Mar. 1987.

*Primary Examiner*—Carl D. Friedman
*Assistant Examiner*—Robert J. Canfield
*Attorney, Agent, or Firm*—Kelly Bauersfeld & Lowry

[57] ABSTRACT

An improved turntable is provided for use in a building, such as in a residential or office environment, wherein the turntable is constructed from modular components for facilitated installation within a relatively low profile space. The turntable comprises a skeletal frame including an outer rim in combination with a plurality of radially extending support beams, wherein the assembled frame defines a plurality of generally pie-shaped openings for nested reception of a corresponding plurality of lightweight modular panel units. Wheels are mounted to the outer rim in adjacent pairs on opposite sides of each radial support beam for shared distribution of loads applied to the turntable during use. A traction drive surface is formed on the periphery of the outer rim in a position engaged by a drive roller of a low profile drive unit.

20 Claims, 4 Drawing Sheets

FIG. 1
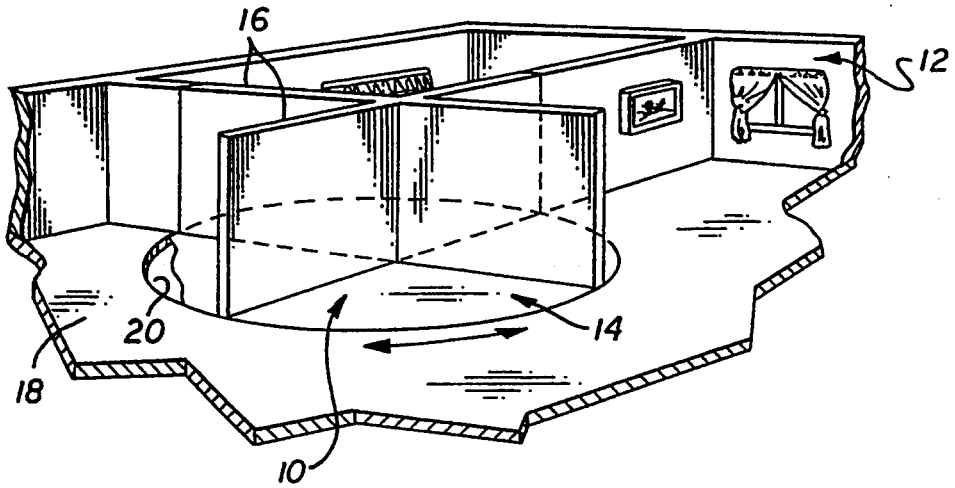
FIG. 2
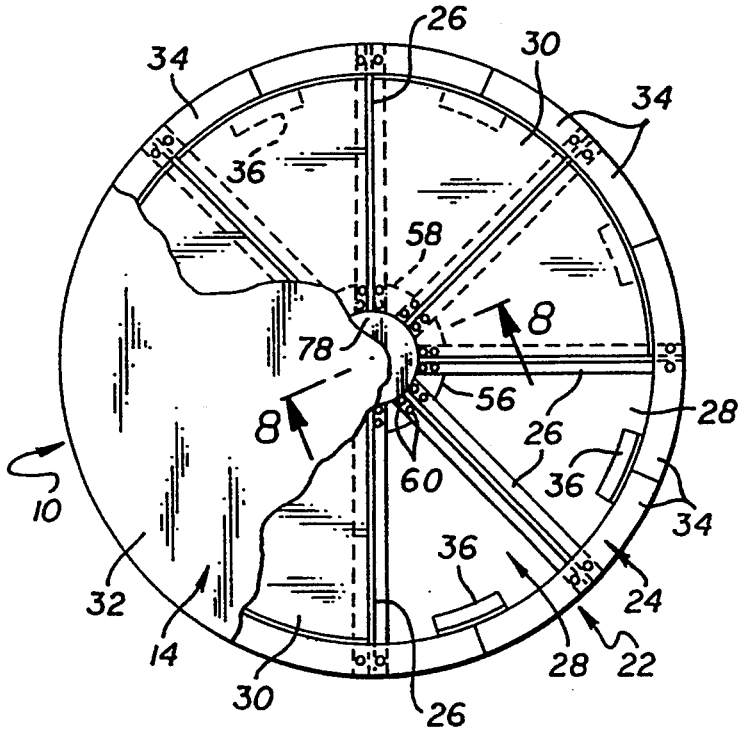
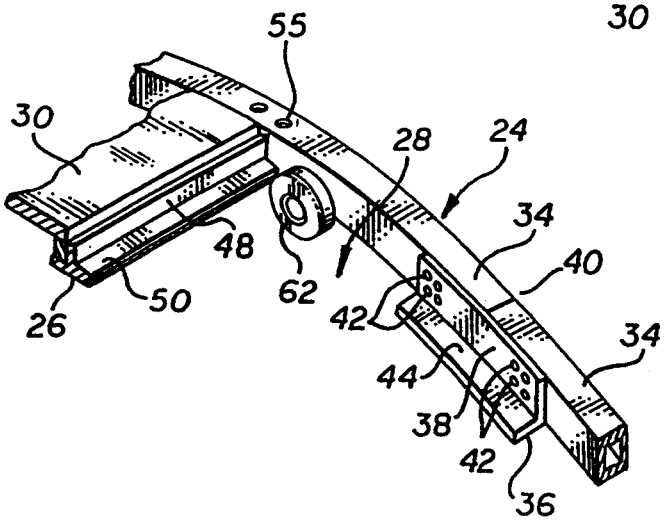
FIG. 3

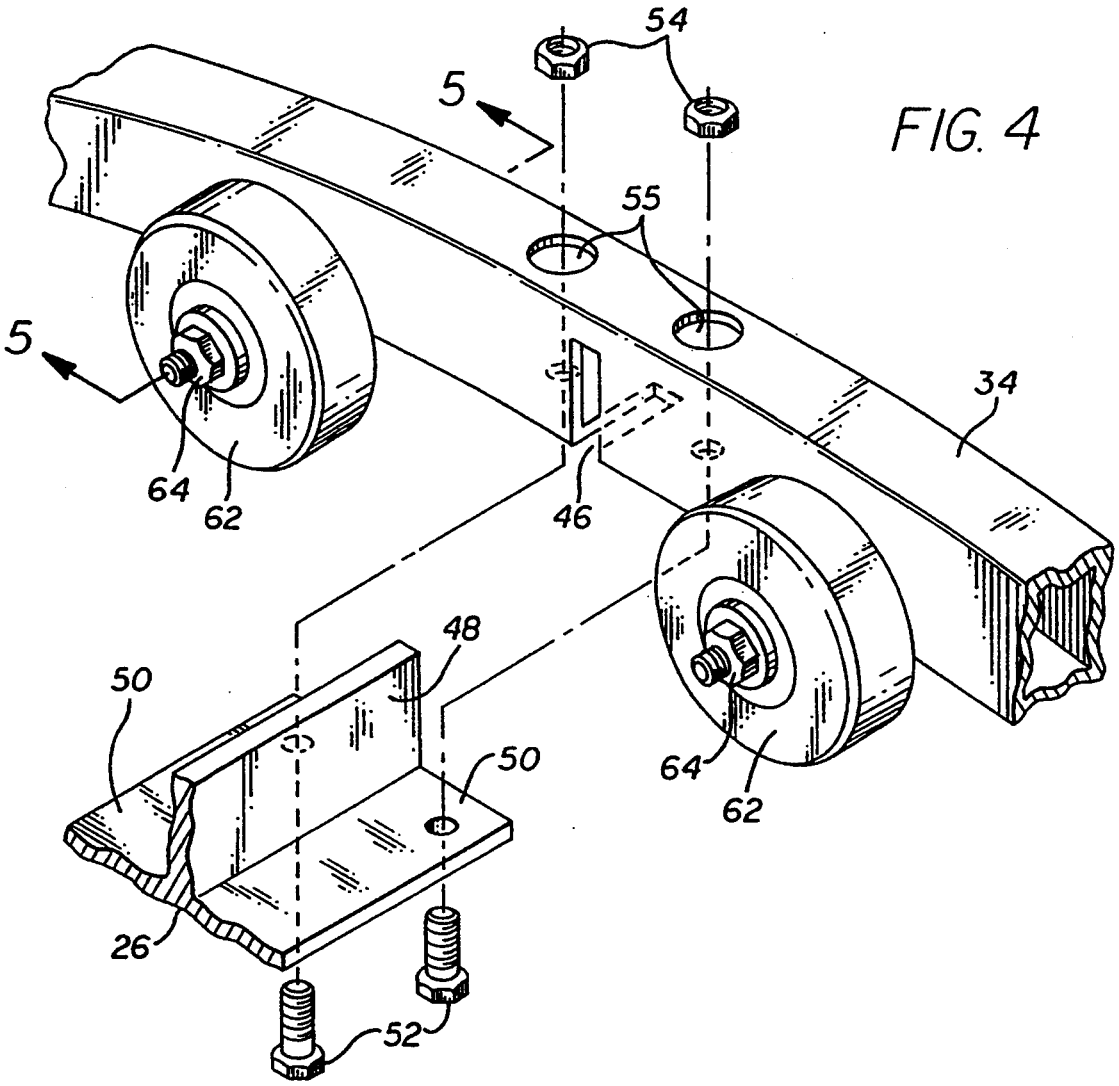
FIG. 4
FIG. 5
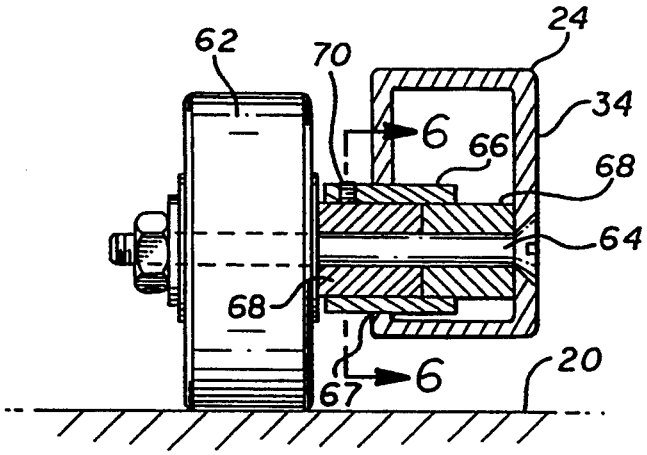
FIG. 6
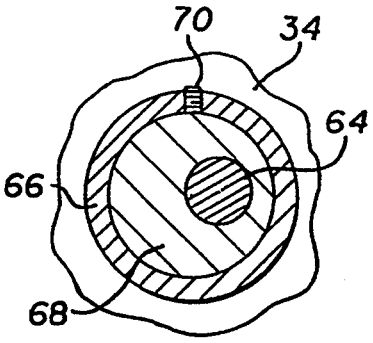

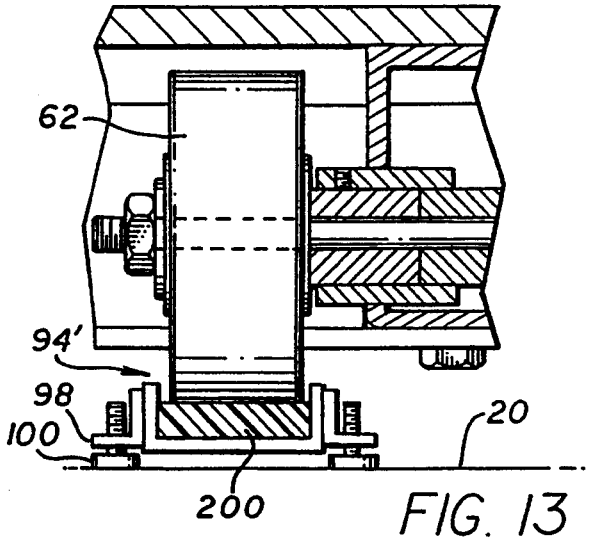
FIG. 13
FIG. 7
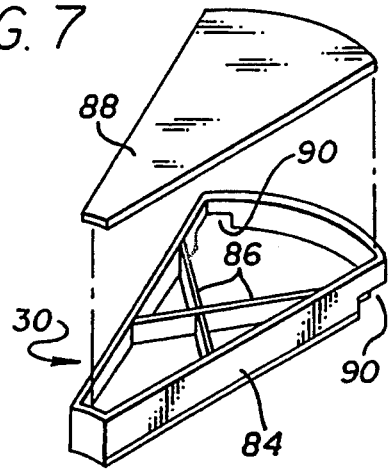
FIG. 8
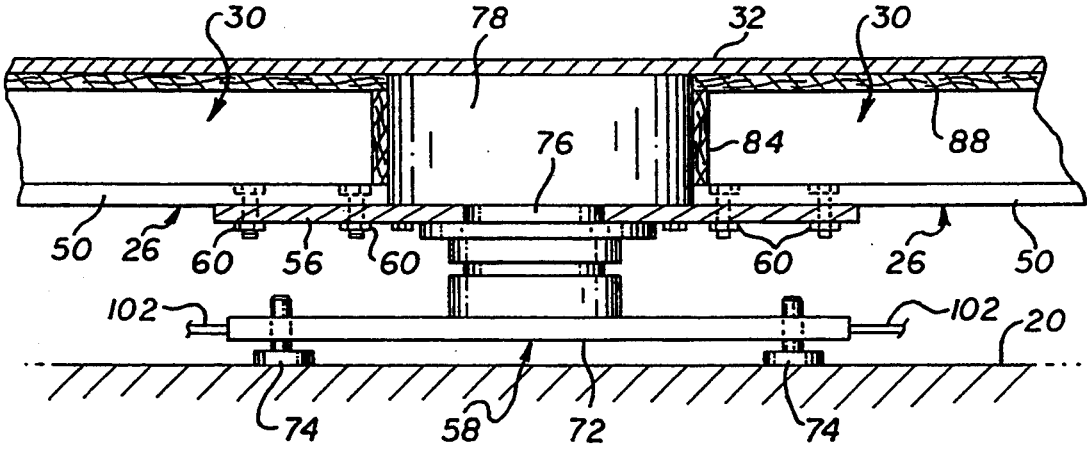
FIG. 9
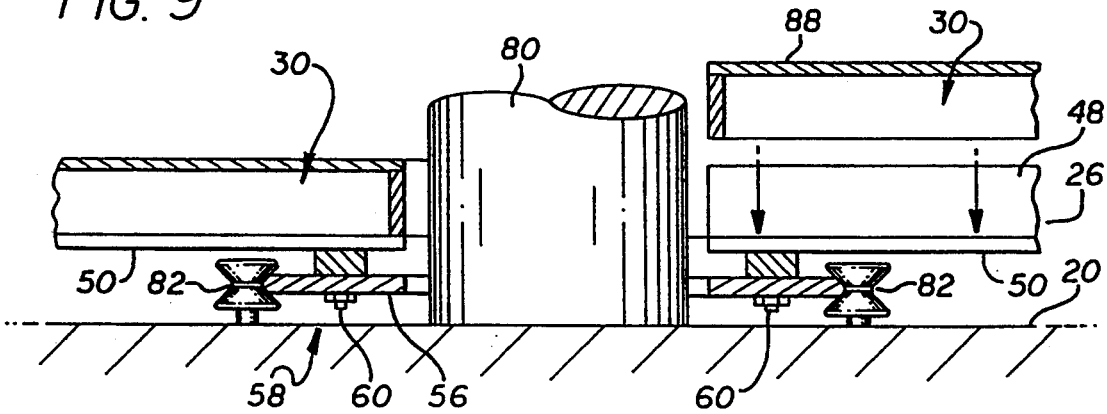

MODULAR TURNTABLE CONSTRUCTION

BACKGROUND OF THE INVENTION

This invention relates generally to turntables of a type adapted for installation into a building structure to provide a rotatable floor surface. More specifically, this invention relates to an improved turntable of relatively lightweight modular design for facilitated and economical installation into a building structure.

Turntables are generally known in the art for installation into a building, such as a residential or commercial structure, to provide a rotatable floor surface for example, rotatable turntables have been employed in restaurants to slowly rotate diners through a circular path and thereby alter the view through exterior windows of the building. See, for example, U.S. Pat. Nos. 3,125,189; 3,388,513; 3,491,496; and 4,817,245. Turntable structures have also been proposed for use in a variety of other commercial establishments, such as medical examination and treatment facilities, multipurpose auditorium structures, and vehicular parking structures. See, for example, U.S. Pat. Nos. 3,383,810; 3,395,500; 3,399,501; 3,675,378; and 3,696,805. Residential turntable structures have also been proposed for rotatably displacing all or part of the structure in a residential dwelling, in accordance with energy efficiency requirements, multipurpose usages of floor space, and the like. See, for example, U.S. Pat. Nos. 2,764,783; 3,078,522; 2,823,425; 3,933,400; and 4,644,705.

In general terms, prior art turntables for use in a building have comprised relatively complicated and costly systems of customized design for installation into a building as a permanent fixture. In this regard, such turntables have typically been installed at the time of initial building construction, with the building structure reflecting substantial and costly nonstandard structural features required to accommodate the size and weight of the custom-designed turntable. That is, prior turntables have typically comprised a circular rotatable platform in combination with underlying support structure and related drive means, all of which collectively occupy a vertical space of substantial dimension, and particularly wherein this vertical profile of the turntable exceeds a typical pedestrian step height of approximately four to seven inches. Accordingly, major deviations from standard building construction practices are usually required to construct a recess of nonstandard depth in the building floor in order to orient the turntable in a flush configuration with surrounding floor surfaces. Alternatively, or in addition, major building modifications are normally required to elevate room ceiling height to accommodate turntable installation in a step-up configuration relative to surrounding floor surfaces. Moreover, prior turntables have been relatively heavy with purportedly lightweight versions still exceeding about twenty pounds per square foot of turntable area, often resulting in a need for structural reinforcement of the building when a turntable is used. Such modifications to standard building structures are, of course, both complex and costly, and frequently preclude installation of a turntable into an existing building structure. Moreover, once the turntable is installed, subsequent removal as may be desired to suit changing occupant requirements can also entail costly modifications to the building structure.

The present invention overcomes the problems and disadvantages encountered in the prior art by providing an improved turntable of a lightweight and modular design adapted for relatively simple and inexpensive installation into and/or subsequent removal from a building structure, without requiring significant or costly customized structure modifications to the building.

SUMMARY OF THE INVENTION

In accordance with the invention, an improved turntable of modular construction is provided for facilitated installation into a building to provide a convenient and multipurpose rotatable floor surface. The turntable is assembled from modular and relatively lightweight components adapted for quick and easy assembly within a low profile space compatible with standard building structural requirements. The turntable can thus be installed relatively economically into a building at a selected location, and, if desired, subsequently removed, all without requiring significant or costly customized modifications to the basic building structure.

In the preferred form, the modular turntable comprises a skeletal frame in combination with a plurality of lightweight modular panel units. More particularly, the skeletal frame includes an outer rim of circular shape assembled with a plurality of radially extending support beams of inverted T-shaped construction. The radial support beams are connected in turn at their inner ends to a central bearing unit having means for rotatably supporting the turntable. The outer rim cooperates with the radial support beams to define a plurality of generally pie-shaped openings for nested reception and support of a corresponding plurality of the modular panel units each having a lightweight skeletal frame construction. Support wheels are mounted to the outer rim at an inboard side thereof in adjacent pairs disposed on opposite sides of each radial support beam to provide shared distribution of loads applied to the assembled turntable during normal use. The support wheels are elevationally adjustable to permit fine tuning of horizontal turntable orientation. The support wheels are arranged in a circular array for riding upon an underlying circular wheel track which may also include elevational adjustment means.

The outer rim is formed from an assembled plurality of arcuate rim segments adapted for connection end-to-end to form the circular rim structure. Adjacent arcuate rim segments are interconnected by an L-shaped mounting bracket having a vertical leg connected to the aligned rim segments at an inboard side thereof. A horizontal leg on the mounting bracket protrudes radially inwardly from the assembled outer rim and cooperates with the inverted T-shaped support beams to provide vertical support for the modular panel units. In one preferred form, the rim segments are provided with a length such that one of the L-shaped mounting brackets is associated with each one of the modular panel units.

A traction drive surface is mounted on the outer periphery of the assembled rim, preferably in a removable manner to permit periodic replacement thereof. The traction drive surface is positioned for engagement by a rotatably driven drive roller of a modular drive unit mounted at a selected and convenient location at the periphery of the turntable.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented and somewhat schematic perspective view illustrating a turntable embodying the novel features of the invention and depicted as installed into a residential dwelling;

FIG. 2 is a top plan view of the turntable shown in FIG. 1, illustrated somewhat in schematic form and having portions thereof broken away to illustrate construction details;

FIG. 3 is an enlarged fragmented perspective view illustrating assembly of a skeletal frame for the turntable;

FIG. 4 is an enlarged and exploded fragmented perspective view illustrating further construction details of the skeletal frame;

FIG. 5 is a vertical sectional view taken generally on the line 5—5 of FIG. 4;

FIG. 6 is an enlarged fragmented vertical sectional view taken generally on the line 6—6 of FIG. 5;

FIG. 7 is an exploded perspective view showing a modular panel unit for use in the invention;

FIG. 8 is an enlarged fragmented vertical sectional view taken generally on the line 8—8 of FIG. 2, and showing a central bearing unit for rotatably supporting the turntable;

FIG. 9 is an enlarged fragmented and exploded sectional view depicting an alternative construction for the central bearing unit, adapted for turntable installation about a vertical column in a building;

FIG. 13 is an enlarged fragmented sectional view similar to a portion of FIG. 11, but depicting an elevationally adjustable wheel track in an alternative preferred form.

DETAILED DESCRIPTION OF THE PREFERRED EMBODIMENTS

Figure 10:
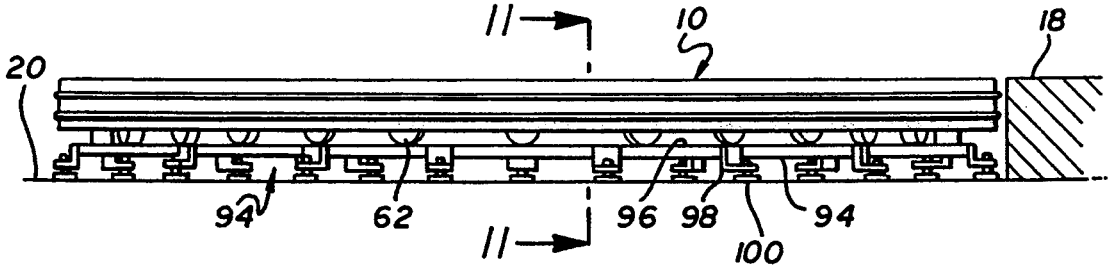
FIG. 10 is an elevational view, shown somewhat in schematic form, illustrating the assembled turntable installed for rotation on an elevationally adjustable wheel track.

As shown in the exemplary drawings, an improved turntable of modular construction referred to generally in FIG. 1 by the reference numeral 10 is provided for installation into a building 12, such as in a residential dwelling as depicted in FIG. 1. The turntable 10 provides a rotatable floor surface 14 which may additionally support wall segments 16 and/or other items such as furniture (not shown), etc. In use, the turntable 10 is selectively rotatable to displace the floor surface 14 within the the building, relative to a surrounding floor surface 18, for purposes of accommodating selected multipurpose uses. The turntable 10 is constructed from modular components adapted for facilitated and cost-efficient installation into and/or subsequent removal from the building 12, all without requiring major or substantial customized structural changes to the building.

In general terms, the modular turntable 10 of the present invention is constructed from relatively lightweight components which can be delivered to and assembled within the building 12, subsequent to initial construction of the building structure. In assembled form, the turntable 10 has a relatively low profile geometry, preferably on the order of six inches or less, for compatibility with standard step-up or step-down structures. Moreover, the assembled turntable includes load distribution features for supporting the turntable at a large plurality of support points, thereby minimizing structural point loading which would otherwise require building modifications to accommodate turntable mass. The turntable 10 is adapted for fine-tuned elevational adjustments and possesses a height degree of structural rigidity with sufficient inter-module flex to achieve smooth-running and stable operation with respect to a standard support substrate 20, such as a concrete slab which typically exhibits minor deviations from a true horizontal plane.

As shown in FIGS. 2–4, the turntable 10 comprises a skeletal frame 22 adapted for facilitated assembly from modular components to include a circular outer rim 24 connected with a plurality of radially extending support beams 26. The outer rim 24 and the radial support beams 26 provide an open spoked wheel structure defining a plurality of generally pie-shaped openings or pockets 28 for nested reception of a corresponding plurality of lightweight and generally pie-shaped modular panel units 30. A suitable floor skin 32 (FIGS. 2 and 8) is then installed over the skeletal frame 22 and panel units 30 to define the circular floor surface 14 upon which finish materials such as carpeting and the like (not shown) may be installed.

With reference to FIGS. 2 and 3, the outer rim 24 is formed from a plurality of arcuate rim segments 34 shown with a square or rectangular hollow cross-sectional shape. The rim segments 34 are formed from a relatively high strength but desirably lightweight material, such as steel tubing for connection end-to-end to form the full circle outer rim 24. In the preferred form, the rim segments 34 are provided in a number corresponding with the number of pie-shaped openings 28 in the assembled skeletal frame 22 (FIG. 2), with each adjacent pair of rim segments 34 being rigidly interconnected at a point generally midway between the adjacent radial support beams 26.

The arcuate rim segments 34 are interconnected end-to-end by generally L-shaped mounting brackets 36 disposed at the inboard sides of the end-aligned rim segments. Each mounting bracket 36 includes a vertical leg 38 (FIG. 3) positioned to lie substantially flush along the inboard sides of the end-aligned rim segments 34, with the vertical leg 38 bridging the joint 40 therebetween. Mounting bolts 42 are provided for securely attaching the bracket leg 38 to both of the adjacent rim segments 34, thereby rigidly interconnecting the two rim segments in end -to-end relation. The mounting brackets 36 thus provide means for quickly and easily interconnecting the multiple rim segments 34 in end-to-end relation to form the rigid circular outer rim 24. Each mounting bracket 36 additionally includes a horizontal leg 44 which protrudes radially inwardly a short distance from the rim segments 34, and provides a horizontal support surface for use in supporting the associated modular panel unit 30, as will be described. The horizontal bracket leg 44 additionally functions to stiffen the adjacent vertical leg 38 of the mounting bracket, and thereby correspondingly stiffen the end-aligned connection of the rim segments 34 in a lightweight and easily assembled structure.

The radial support beams 26 have an inverted T-shaped construction with outer ends adapted for connection to the outer rim 24. As shown best in FIG. 4, the rim segments 34 defining the outer rim 24 have mounting slots 46 formed in the inboard and bottom faces thereof for slide-fit reception of a vertical leg 48 on the inverted T-shaped radial support beam 26. When the radially outermost end of the beam leg 48 is slide-fitted into the associated mounting slot 46, the outermost end of a horizontal beam leg 50 underlies the rim 24 on opposite sides of the mounting slot 46. Connector bolts 52 are passed upwardly through the beam leg 50 on opposite sides of the slot 46 for secure attachment to the rim 24. As shown in FIG. 4, nuts 54 are threaded onto the connector bolts 52 by accessing said bolts 52 via access ports 55 formed in a top wall of the outer rim 24.

The inner ends of the radial support beams 26 are connected in turn to a central bearing ring 56 (FIGS. 2 and 8) of a central bearing unit 58. More specifically, additional connector bolts 60 are fastened through the horizontal leg 50 of each radial beam 26, on opposite sides of the associated vertical beam leg 48, for secure attachment to the bearing ring 56. The resultant assembled skeletal frame 22 has a rigid yet lightweight circular construction, with the radial support beams 26 cooperating with the outer rim 24 to define the pie-shaped openings 28.

A plurality of support wheels 62 are mounted onto the outer rim 24 to provide rolling support at the turntable periphery. These support wheels 62, as shown in FIGS. 4–6, are installed in pairs, with each wheel pair being disposed on opposite sides of an associated radial support beam 26. The support wheels 62 are positioned at the inboard sides of the outer rim by means of axle bolts 64 extending through the rim 24. A bearing sleeve 66 is seated within an opening 67 at the inboard side of the rim 24, and the axle bolt 64 extends through one or more bushings 68 carried within the bearing sleeve 66. As shown in FIG. 6, the bushings 68 have an eccentric or offset configuration and are adapted to be rotationally set and locked within the bearing sleeve 66 by means of a set screw 70, for purposes of elevationally adjusting the associated support wheel 62 with respect to the skeletal frame. The bearing sleeve 66 is preferably formed from a plastic material having a minor degree of resilience in order to accommodate relatively uniform wheel load distribution with respect to adjacent whole or when multiple wheels are mounted in grouped fashion on a common common axle.

The central bearing unit 58 is shown in one preferred form in FIG. 8. As shown, the bearing unit 58 includes a support platform 72 positioned on the substrate 20 by means of a circumferentially spaced array of elevationally adjustment support screws 74. The support platform 72 in turn carries a bearing block 76 for rotatably supporting the central bearing ring 56 about a vertical axis constituting the center of rotation for the turntable. A circular filler hub 78 comprises a spacer element to fill the space at the radially innermost ends of the support beams 26 and modular panel units 30, as will be described.

FIG. 9 shows an alternative form of the central bearing unit identified by reference numeral 58' and adapted for mounting of the turntable 10 about a preexisting vertical column 80 of a building. In this version, the central bearing ring 56 comprises an annular bearing plate or ring suspended from the radial inner periphery of the support beams 26, wherein an outer margin of the bearing ring 56 is rollingly engaged within a circumferential array of bearing rollers 82. These bearing rollers 82 may be desirably attached to the substrate 20 in any suitable manner. With this alternative construction, the turntable can be assembled to provide a rotatable floor surface of annular shape, wherein the floor surface is rotatable about the building column 80.

The panel units 30 comprise lightweight modular components adapted for drop-in nested reception into the skeletal frame 22, to fill the pie-shaped openings 28 formed in the skeletal frame. FIG. 7 shows one of the panel units 30 in accordance with one preferred configuration. More specifically, the illustrative panel unit 30 comprises a hollow lightweight skeletal panel frame 84 with appropriate internal reinforcement members 86 and an overlying cover plate 88. The thus-constructed panel unit 30 has an overall size and shape for nested mounting into a corresponding one of the openings 28 in the skeletal frame 22, with vertical support for the panel unit 30 being provided by the horizontal legs 50 of the two radial support beams 26 lining opposite sides of the opening 28. In addition, vertical support for the panel unit 30 is provided by the horizontal leg 44 of the associated mounting bracket 36. Mounting bolts (not shown) or other suitable fastener elements may be provided to attach the panel units 30 to the frame 22, if desired. Conveniently, the outer corners of the panel unit 30 includes appropriate cutouts or notches 90 to prevent structural interference with the associated support wheels 62 connected to the outer rim 24.

The thus-assembled turntable 10, including the skeletal frame 22 and modular panel units 30, is preferably mounted onto a wheel track 94 (FIG. 10) installed within a turntable recess of the building. This wheel track 94 is shown generally in FIGS. 10 and 11 and comprises a circular track surface 96 defined by stock of rectangular cross section or other shape, such as a U-shaped geometry, from a suitable material such as metal or plastic. The diametric size of the wheel track 94 is selected to correspond with the diametric position of the support wheels 62, such that the wheels 62 ride upon the track surface 96 as the turntable is rotated. A plurality of L-shaped adjustment brackets 98 are mounted at regularly spaced intervals along the wheel track 94 and include elevational adjustment screws 100 threaded through horizontal legs thereof to permit fine-tuned horizontal adjustment of the track surface relative to the supporting substrate 20. The radial position of the wheel track 94 may be fixed relative to the turntable, without requiring permanent attachment of the wheel track 94 or the turntable to the building structure, by means of tie rods 102 (FIG. 8) extending between the central bearing unit 58 and the wheel track 94.

Further construction details of the wheel track 94, including elevational adjustment thereof and related interconnection with the central bearing unit, may be found by reference to copending U.S. Ser. No. 055,382, filed May 3, 1993, which is incorporated by reference herein. In this regard, in some applications, it may be necessary or desirable to use an inner ring of support wheels to provide additional turntable support, as described in Ser. No. 055,382.

Figure 11:
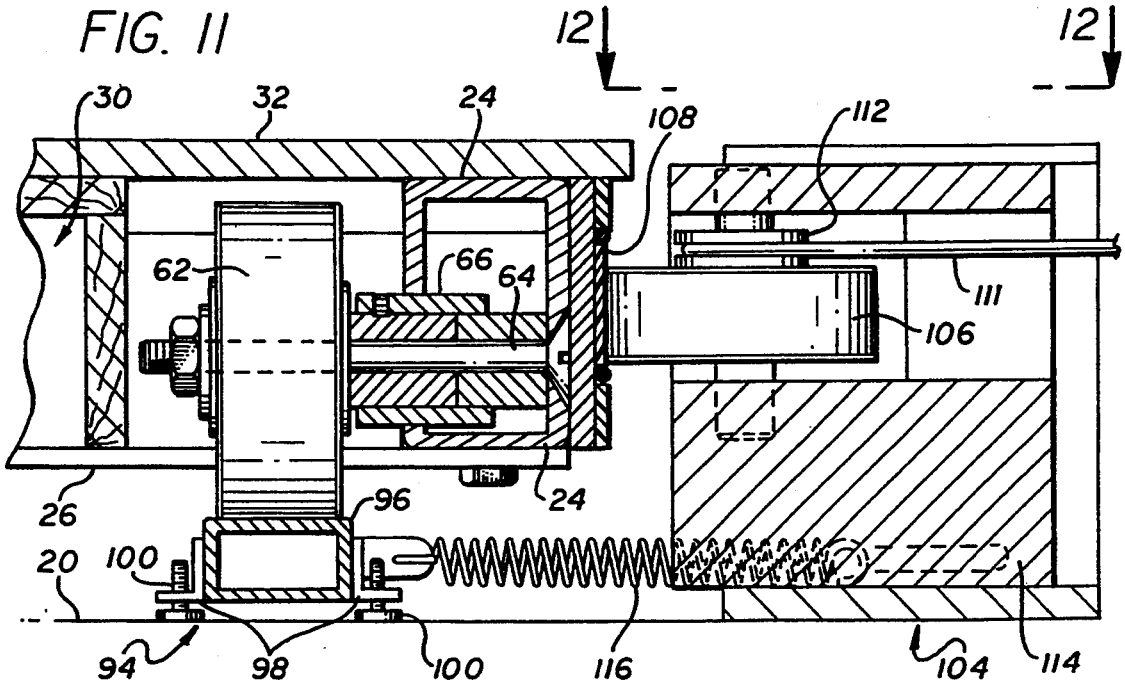
FIG. 11 is an enlarged fragmented vertical sectional view taken generally on the line 11—11 of FIG. 10, and illustrating a modular drive unit in operative engagement with the periphery of the assembled turntable.
Figure 12:
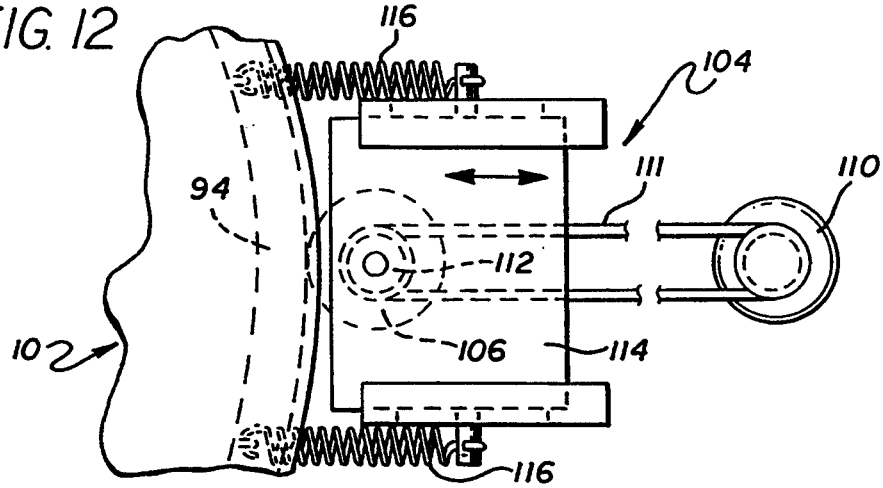
FIG. 12 is a fragmented plan view of the modular drive unit, taken generally on the line 12—12 of FIG. 11.

FIGS. 11 and 12 illustrate a modular drive unit 104 of low profile configuration for rotatably and reversibly driving the turntable 10. As shown, the drive unit 104 is installed at a selected position disposed about the turntable periphery, and includes a drive roller 106 engaged with a traction surface 108 on the periphery of the turntable. The drive roller 106 may be driven from a reversible drive motor 110 by means of a drive belt 111 and pulley 112, with the drive roller 106 being carried on a slide carriage 114 biased by compression springs 116 toward drive roller engagement with the traction drive surface 108 on the turntable. Further construction details of the traction drive surface 108 and preferred removable mounting thereof on the turntable periphery may be found by reference to copending U.S. Ser. No. 055,382, which is incorporated by reference herein.

FIG. 13 shows a modified wheel track 94' for supporting the wheels 62 on the turntable 10. In this embodiment, the wheel track 94' is defined by U-shaped channel stock supported in an upwardly open orientation by L-shaped brackets 98 which are in turn mounted at vertically adjustable positions by adjustment screws 100. This arrangement permits the wheels 62 to be located closer to the floor or substrate 20, thereby reducing overall turntable height. A wheel track member 200 is desirably seated within the channel to provide a smooth-surfaced and long-wearing bearing track for the wheels. In a preferred form, the track member 200 can comprise a curable epoxy resin or the like poured into the channel in a liquid state after track installation and then allowed to cure before turntable installation. The resultant bearing track thus flows to and then cures at a substantial and accurate horizontal orientation for smooth wheel movement thereon.

The assembled turntable 10 of the present invention thus provides a lightweight, modular and easily assembled structure which has a low profile compatible with standard building structural requirements. The lightweight nature of the turntable components, in combination with shared load distribution obtained by mounting the support wheels in adjacent pairs, permits use of the turntable in virtually any building structure without requiring major structural revisions or renovations. The turntable is conveniently installed within the building with minimal affixation to the building structure, thereby permitting subsequent disassembly and removal of the turntable, if desired, with minimal disruption to the building.

A variety of further modifications and improvements to the modular turntable 10 of the present invention will be apparent to those skilled in the art. Accordingly, no limitation on the invention is intended by way of the forgoing description and accompanying drawings, except as set forth in the appended claims.

What is claimed is:

1. A turntable for installation into a building, comprising:

a skeletal frame including a generally circular outer rim and a plurality of radial support beams having outer ends connected to said rim and cooperating therewith to define a plurality of generally pie-shaped openings;

center bearing means disposed generally at inner ends of said radial support beams for supporting said skeletal frame for rotation about a central axis;

a plurality of support wheels each including an axle mounted on said outer rim for rotatably supporting said frame, said support wheels being mounted on said outer rim in pairs with one wheel of each pair disposed at opposite sides of a corresponding one of said radial support beams; and a plurality of modular panel units for reception respectively into said pie-shaped openings in said skeletal frame, said frame including means for vertically supporting said panel units.

2. The turntable claim 1 wherein said panel units are nested within said skeletal frame.

3. The turntable of claim 1 wherein each of said radial support beams has an inverted generally T-shaped construction defining a generally vertical leg and a lower horizontal leg, said horizontal leg defining support surfaces on opposite sides of said vertical leg for vertically supporting a pair of said panel units.

4. The turntable of claim 1 including means for elevationally adjusting said wheels relative to said skeletal frame.

5. The turntable of claim 1 wherein the axle for each of said wheels is carried eccentrically within a wheel bearing, and further including means for rotatably adjusting the position of said wheel axle relative to said wheel bearing to elevationally adjust said wheel relative to said skeletal frame.

6. The turntable of claim 1 further including a circular wheel track for rolling support of said wheels.

7. The turntable of claim 6 wherein said wheel track includes a track channel of generally U-shaped and upwardly open cross section.

8. The turntable of claim 7 further including a track member seated within said track channel for rolling support of said wheels.

9. The turntable of claim 6 wherein said wheel track defines an annular wheel support surface, and includes means for elevationally adjusting said wheel support surface.

10. The turntable of claim 1 further including drive means for rotatably driving said turntable about said central axis.

11. The turntable of claim 10 wherein said drive means includes a drive roller in bearing engagement with a peripheral turntable edge defined by said outer rim.

12. The turntable of claim 11 further including a traction drive tread mounted removably on said peripheral edge for bearing engagement by said drive roller.

13. A turntable for installation into a building, comprising:

a skeletal frame including a generally circular outer rim and a plurality of radial support beams having outer ends connected to said rim and cooperating therewith to define a plurality of generally pie-shaped openings;

said outer rim comprising a plurality of arcuate-shaped rim segments, and means for connecting said rim segments in end-to-end relation to form said circular outer rim;

center bearing means disposed generally at inner ends of said radial support beams for supporting said skeletal frame for rotation about a central axis;

a plurality of support wheels mounted on said skeletal frame proximate the periphery thereof for rotatably supporting said frame; and a plurality of modular panel units for reception respectively into said pie-shaped openings in said skeletal frame, said frame including means for vertically supporting said panel units;

said connecting means comprising a plurality of mounting brackets each connected between an adjacent pair of said rim segments at an inboard side thereof, each of said mounting brackets having an L-shaped construction to include a generally vertical leg extending along the inboard side of said rim segments and a generally horizontal leg protruding radially inwardly from said rim segments, said horizontal leg providing a support surface for vertically supporting one of said panel units.

14. The turntable of claim 13 wherein said radial support beams further include generally horizontal support surfaces for vertically supporting said panel units.

15. A turntable for installation into a building, comprising:

a skeletal frame including a generally circular outer rim and a plurality of radial support beams having outer ends connected to said rim and cooperating therewith to define a plurality of generally pie-shaped openings;

center bearing means disposed generally at inner ends of said radial support beams for supporting said skeletal frame for rotation about a central axis;

a plurality of support wheels mounted on said skeletal frame proximate the periphery thereof for rotatably supporting said frame; and a plurality of modular panel units for reception respectively into said pie-shaped openings in said skeletal frame, said frame including means for vertically supporting said panel units;

each of said radial support beams having an inverted T-shaped construction defining a vertical leg and a lower horizontal leg extending outwardly from opposite sides of said vertical leg, said outer rim having a plurality of radially inwardly and downwardly open slots formed therein for respective reception of the vertical legs of said radial support beams in a position with said horizontal legs of said radial support beams underlying said outer rim, and means for connecting said horizontal legs of said radial support beams to said outer rim.

16. A turntable for installation into a building, comprising:

a turntable unit defining an upwardly presented turntable surface area, said turntable unit having an underside with a plurality of support wheels mounted thereon in a generally annular array; and a circular wheel track for rolling support of said wheels, said wheel track including a continuous generally U-shaped and upwardly open track channel, and a curved and self-leveled track member seated within said track channel and defining a substantially horizontal surface for rolling support of said wheels.

17. The turntable of claim 16 wherein said track member comprises a curable and self-leveling liquid agent received into said track channel and cured therein to define said substantially horizontal surface.

18. A turntable for installation into a building, comprising:

a skeletal frame including a generally circular outer rim and a plurality of radial support beams having outer ends connected to said rim and cooperating therewith to define a plurality of generally pie-shaped openings;

center bearing means disposed generally at inner ends of said radial support beams for supporting said skeletal frame for rotation about a central axis;

a plurality of support wheels mounted on said skeletal frame proximate the periphery thereof for rotatably supporting said frame;

a circular wheel track for rolling support of said wheels, said wheel track defining an annular wheel support surface and including means for elevationally adjusting said wheel support surface;

means for structurally connecting said wheel track to said center bearing means; and a plurality of modular panel units for reception respectively into said pie-shaped openings in said skeletal frame, said frame including means for vertically supporting said panel units.

19. A turntable for installation into a building, comprising:

a skeletal frame including a generally circular outer rim and a plurality of radial support beams having outer ends connected to said rim and cooperating therewith to define a plurality of generally pie-shaped openings;

center bearing means disposed generally at inner ends of said radial support beams for supporting said skeletal frame for rotation about a central axis;

a plurality of support wheels mounted on said skeletal frame proximate the periphery thereof for rotatably supporting said frame; and a plurality of modular panel units for reception respectively into said pie-shaped openings in said skeletal frame, said frame including means for vertically supporting said panel units;

each of said wheels including a wheel axle carried within an eccentric bushing which is mounted in turn within a wheel bearing mounted on said skeletal frame, said wheel bushing being rotatable within said wheel bearing to permit infinitely variable elevational adjustment of said wheel axle within a selected range relative to said skeletal frame, and further including stop means for releasibly locking said wheel bushing within said wheel bearing at a selected position of elevational adjustment.

20. A turntable for installation into a building, comprising:

a skeletal frame including a generally circular outer rim and a plurality of radial support beams having outer ends connected to said rim and cooperating therewith to define a plurality of generally pie-shaped openings;

center beating means disposed generally at inner ends of said radial support beams for supporting said skeletal frame for rotation about a central axis, said center bearing means comprising an annular bearing ring connected to said skeletal frame and adapted for mounting about a vertical column in a building, and means for radially constraining said bearing ring;

a plurality of support wheels mounted on said skeletal frame proximate the periphery thereof for rotatably supporting said frame; and a plurality of modular panel units for reception respectively into said pie-shaped openings in said skeletal frame, said frame including means for vertically supporting said panel units.

* * * * *